US006028258A

United States Patent [19]

Hicks et al.

[11] Patent Number: 6,028,258

[45] Date of Patent: Feb. 22, 2000

[54] DRUM BRACKET

[76] Inventors: William J. Hicks, P.O. Box 187, Hawesville, Ky. 42348; Marion J. Saalman, P.O. Box 766, Tell City, Ind. 47586

[21] Appl. No.: 09/128,186

[22] Filed: Aug. 3, 1998

Related U.S. Application Data

[60] Provisional application No. 60/055,767, Aug. 14, 1997.

[51] Int. Cl.[7] ..... G10D 13/02

[52] U.S. Cl. ..... 84/421; 84/422

[58] Field of Search ..... 84/421, 422, 453, 84/327; 248/228.5, 230.5, 231.61, 316.3

[56] References Cited

U.S. PATENT DOCUMENTS 4,422,615 12/1983 McManus ..... 248/475.1
4,453,442 6/1984 LaFlame ..... 84/421
4,836,483 6/1989 Dale, Jr. ..... 248/231.6
5,703,306 12/1997 Liao ..... 84/421
5,799,917 9/1998 Li ..... 248/284.1

*Primary Examiner*—Robert E. Nappi
*Assistant Examiner*—Kim Lockett
*Attorney, Agent, or Firm*—George W. Morgan Patent Agent

[57] ABSTRACT

The bracket assembly is a device for mounting accessories such as blocks or bells to drums. The assembly is secured to a drum rim by two plates that clamp on the rim. The assembly has a variety of fastening arrangements such that the assembly provides for accessory height adjustment as well as accommodating accessory mounting aperture location variations for accessories mounted on to the bracket assembly.

5 Claims, 6 Drawing Sheets

DRUM BRACKET

This application claims the benefit of U.S. Provisional Application No. 60/055,767 filed Aug. 14, 1997.

BACKGROUND OF THE INVENTION

1. Field of the Invention

The present invention is a bracket assembly usable for mounting a musician's accessory, such as a block or a bell, to a drum.

2. Background Information

Musicians who are drummers often have accessories, such as blocks or bells, mounted on a base drum. Drummers beat on the accessories, such as blocks or bells, with drumsticks to attain sounds which many people consider musical. However, mounting such accessories at the foot of a base drum, as is now common to the trade, is not as convenient an arrangement for many drummers as would be mounting the accessories to the top of a drum such as a snare drum or a tom drum. Also, as commercially available musical blocks have a variety of mounting clearance spacings, it has been difficult for musicians to match block mounting arrangements with commercially available after-market blocks intended for musical purposes.

As will be seen from the subsequent description of the present invention, the shortcomings of mounting an accessory item such as a block or bell to a drum can be overcome with the present invention.

SUMMARY

The present invention is a bracket assembly for mounting a musical accessory such as a block or a bell to a drum that permits the musical accessory to be more accessible to a drummer than present mounting arrangements. The bracket assembly mounts on a drum head rim by clamping the rim between an upper plate and a lower plate. The bracket assembly includes fastener arrangements including a means of accessory height adjustment and also a means of accommodating variations in accessory aperture spacings.

DESCRIPTION OF THE PREFERRED EMBODIMENTS

Figure 1:
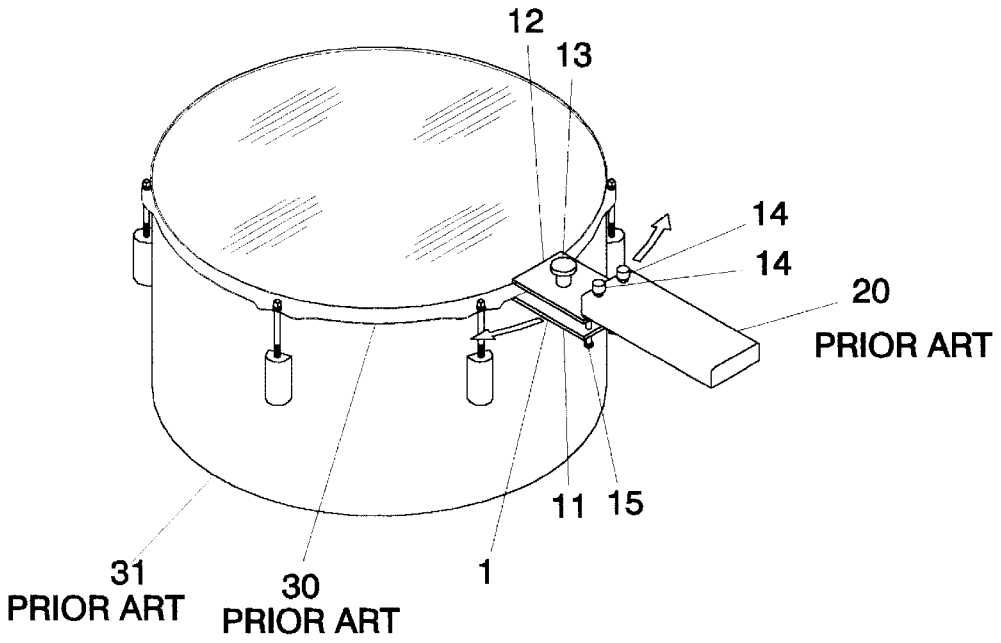
FIG. 1 shows the present invention installed on a drum.

FIG. 1 shows the preferred embodiment of the present invention, a bracket assembly 1 mounted on a prior art drum head rim 30 of a prior art snare drum 31. The bracket assembly 1 is securing a an accessory which is a prior art block 20 in a position convenient for a musician to beat on it with at least one drum stick so as to produce sounds which are considered musical by some people.

FIGS. 1, 2, 3, and 4 show the bracket assembly 1 which comprises a lower plate 11, an upper plate 12, a spring 131, block mount nuts 14, studs 18, location adjustment inserts 40, retaining and height adjustment nuts 19, pivot shoulder bolts 43, a center fastener 13, and tension adjusting thumbscrews 15.

Figure 4:
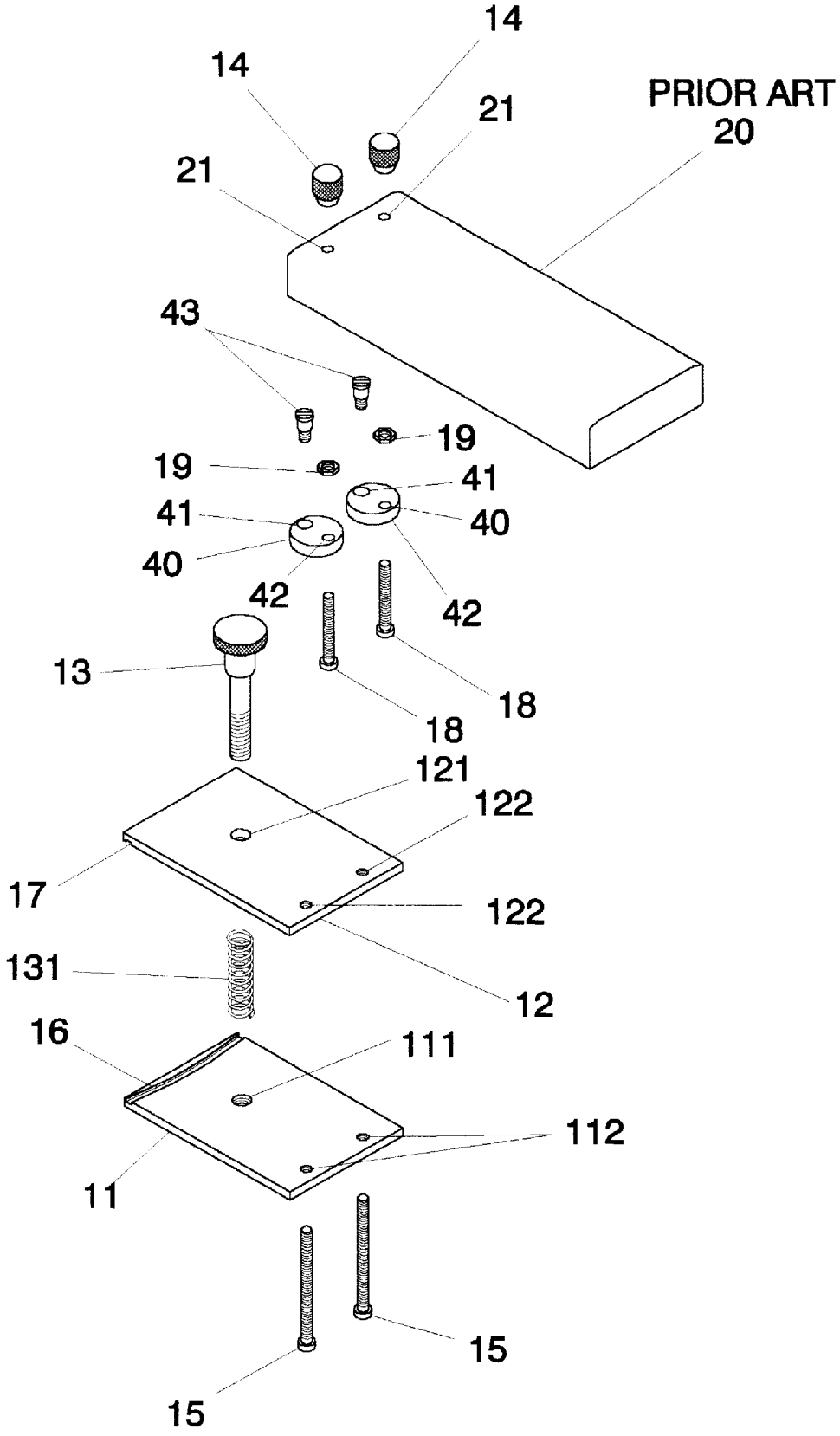
FIG. 4 is an exploded view of the present invention.
Figure 5:
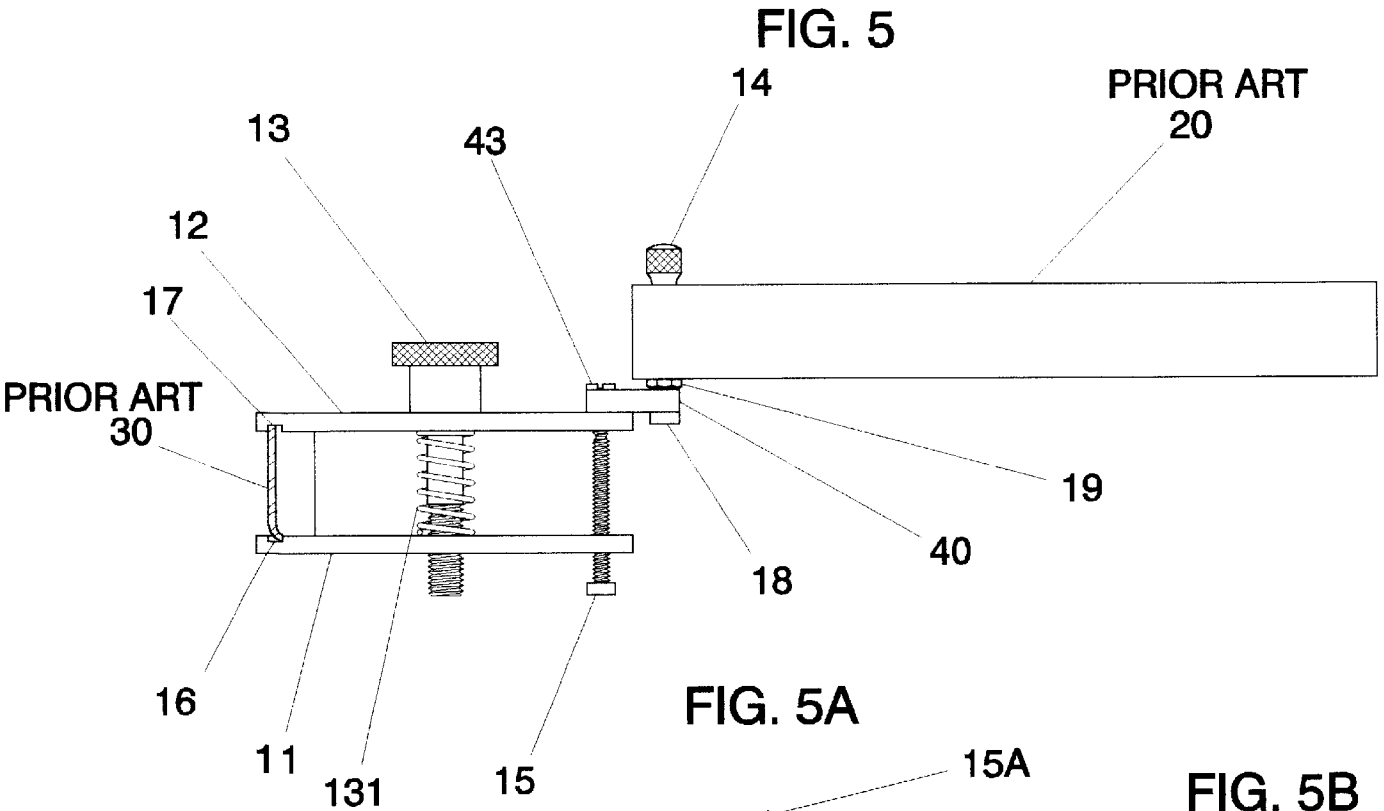
FIG. 5 is a side view of the present invention.

Referring to FIGS. 4 and 5, the upper plate 12 includes a center fastener clearance 121, threaded clearances 122, and a upper plate locating slot 17.

Referring to FIGS. 4 and 5, the lower plate 11 includes a center fastener threaded aperture 111, threaded thumbscrew apertures 112, and a lower plate locating slot 16.

Referring to FIG. 4, the location adjustment inserts 40 each include a pivot clearance 41 and a block mount stud clearance 42.

As shown FIG. 5, the tension adjusting thumbscrew 15 includes a tip 15A.

Figure 5A:
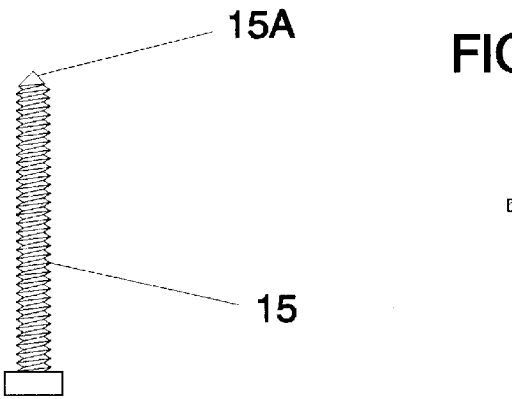
FIGS. 5A and 5B are details of the present invention.
Figure 5B:
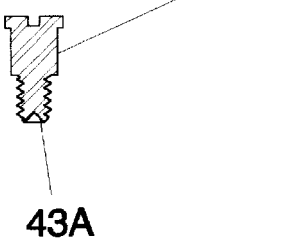

As shown in FIG. 5A, the pivot shoulder bolt 43 includes a dimple 43A, said dimple 43A matching with and receiving the tip 15A, said tip 15A seating in the dimple 43A when the tension adjusting thumbscrews 15 and the pivot shoulder bolts 43 are assembled in the bracket assembly 1.

As shown in FIG. 4, the block 20 has at least one block aperture 21.

As shown in FIGS. 1 and 5, in the preferred embodiment of the present invention, the bracket assembly 1 is assembled onto the drum head rim 30 of the snare drum 31. The slots 16 and 17 grip the rim 30.

As shown in FIGS. 1, 4, and 5, the center fastener 13 inserts thorugh the center fastener clearance 121 of the upper plate 12, through the spring 131, and threads into the center fastener threaded aperture 111 of the lower plate 11.

As shown in FIGS. 4 and 5, the center fastener 13 is a shoulder bolt, so in the bracket assembly 1, the spring 131 exerts a force on the upper plate 12 biasing the upper plate 12 towards the center fastener 13. The spring 131 also applies a force in the opposite direction of the upper plate 12, against the lower plate 11, said lower plate 11 being secured by the threaded end of the center fastener 13 which is engaged in the center fastenere threaded aperture 111 of the lower plate 11. Also, the tension adjusting thumbscrews 15, which are threaded through the threaded aperture 112 of the upper plate 12, exert a force against the pivot shoulder bolts 43 which are threaded into the threaded apertures 122.

Also shown in FIGS. 4, 5, 5A and 5B is how the tension adjusting thumbscrews 15 engage the threaded thumbscrew apertures 111 of the lower plate 11 into the pivot shoulder bolts 43 which are contained by the threaded apertures 122 of the upper plate 12. The pivot shoulder bolts 43 fit thorugh the block mount stud clearances 42 and screw into the threaded apertures 122. The tip 15A centers into and is received by the dimple 43A.

The contact of the tip 15A against the dimple 43A serves as a fulcrum for the upper plate 12 with the pivot shoulder bolts 43 and the lower plate 11 with the tension adjusting thumbscrews 15 so that the center fastner 13 serves to clamp the lower plate 11 and the upper plate 12 against the drum head rim 30 which is how the bracket assembly 1 is mounted to the snare drum 31.

Figure 2:
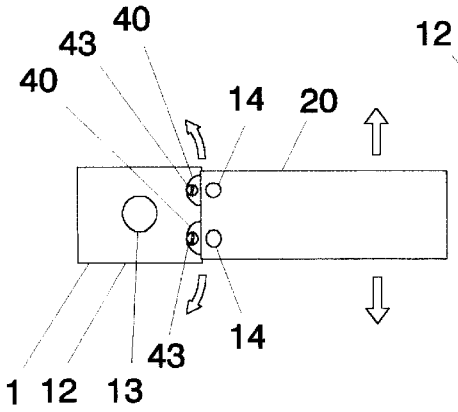
FIG. 2 is a top view of a portion of the present invention including arrows indicating directions of motion.
Figure 3:
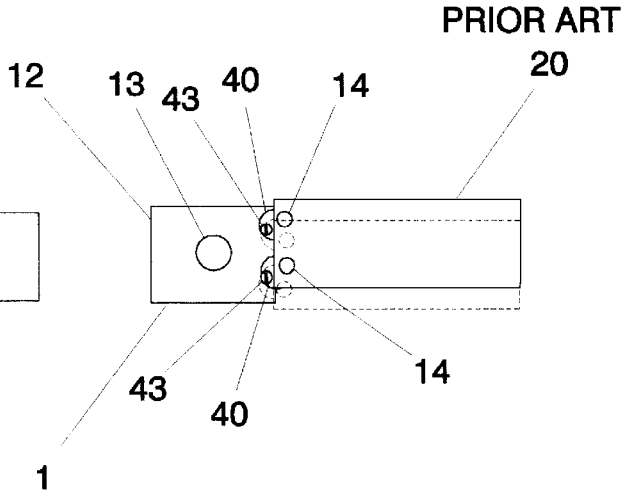
FIG. 3 is a top view of a portion of the present invention in an alternate position.

Because the pivot stud clearance 41 and the block mount stud clearance 42 of the location adjustment insert 40 are clearances, the location adjustment insert 40 can swivel, or rotate in position, as indicated in FIG. 2. This permits block motion as indicated by the arrows showing direction of motion in FIGS. 2 and 3. Also, when there are two block apertures 21, and two location adjustment inserts 40, the fact each insert 40 can swivel in either direction of rotation, provides an accommodation to variations of block aperture 21 center-to-center distances or spacings. The ability of the location adjustment inserts 40 to swivel permits an automatic adjustment to various centerblock aperture 21 spacings. This is an inventive feature of the bracket assembly 1. Another inventive feature is that the block 20 is moveable with respect to the center fastener 13. This ease of movement is seen as desirable to some musicians.

The combination of the location adjustment insert 40 which is attached to the upper plate 12 by means of the pivot shoulder bolt 42, and the block mount stud 18 serves as a support for the block 20, connecting the block 20 to bracket assembly 1.

The block 20 is typical drummer's block, usually of a hard wood, such as is commercially available and is not inventive in itself. The drum head rim 30 is a typical drum head rim as found on drums including snare drums and tom drums.

The retaining and height adjustment nuts 19 retain the block mount studs 18 and also permit height adjustment of the block 20 with respect to the upper plate 12. The block mount nuts 14 are internally threaded so they screw onto the block mount studs 18, which secure the block 20 between the block mount nuts 14 and the retaining and height adjustment nuts 19. The center fastener 13 fits through the center fastener clearance 121 in the upper plate 12, through the spring 131, and into the center fastener threaded aperture 111 in the lower plate 11.

The preferred material of construction of the lower plate 11 and the upper plate 12, in the preferred embodiment of the present invention is plastic, preferrably a clear durable plastic such as LEXAN, which as a Trade Mark of the General Electric Company. The plastic serves an accoustical purpose, isolating the wood block 20 from the drum head rim 30.

Figure 6:
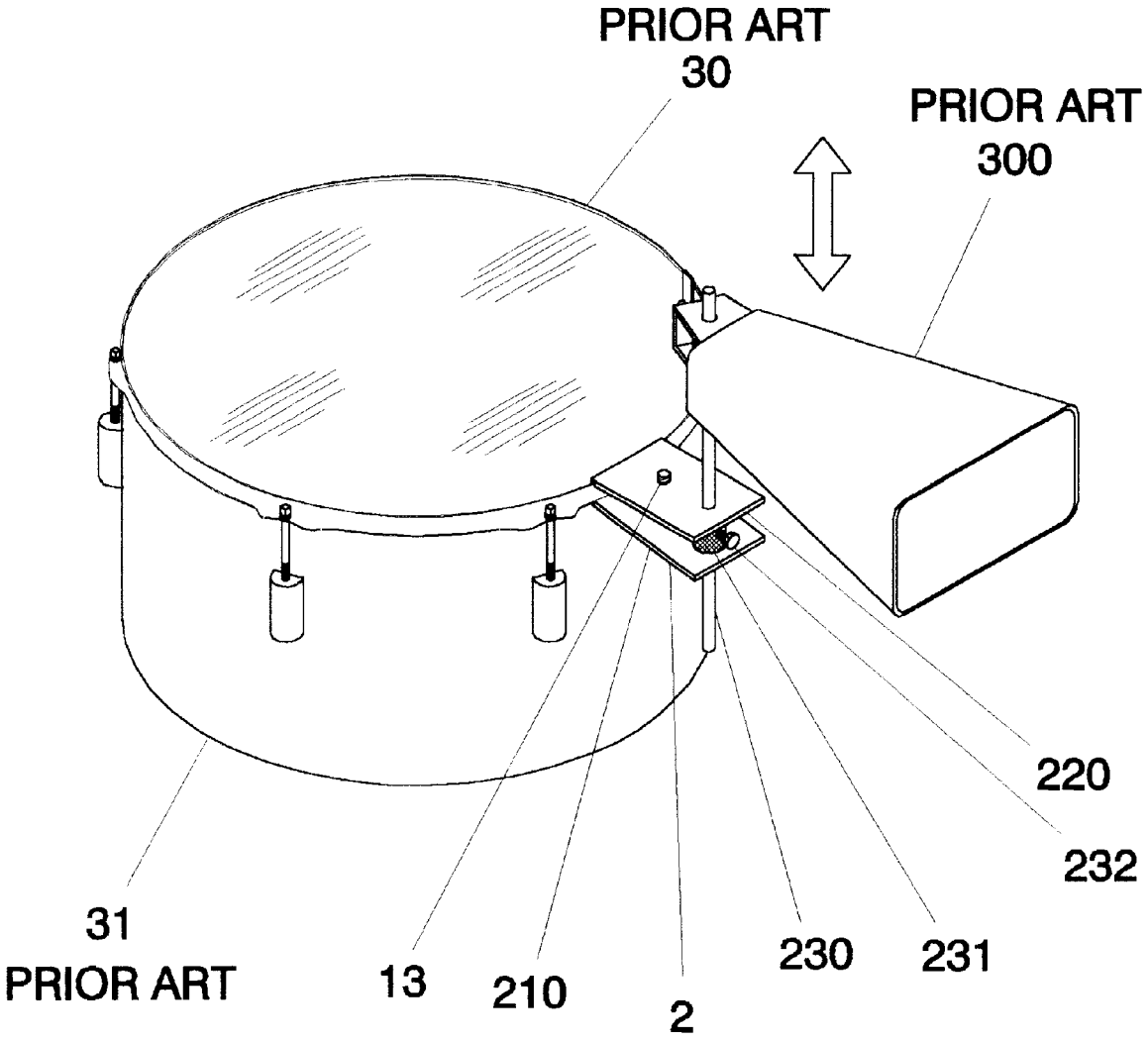
FIG. 6 is an alternate embodiment of the present invention.
Figure 7:
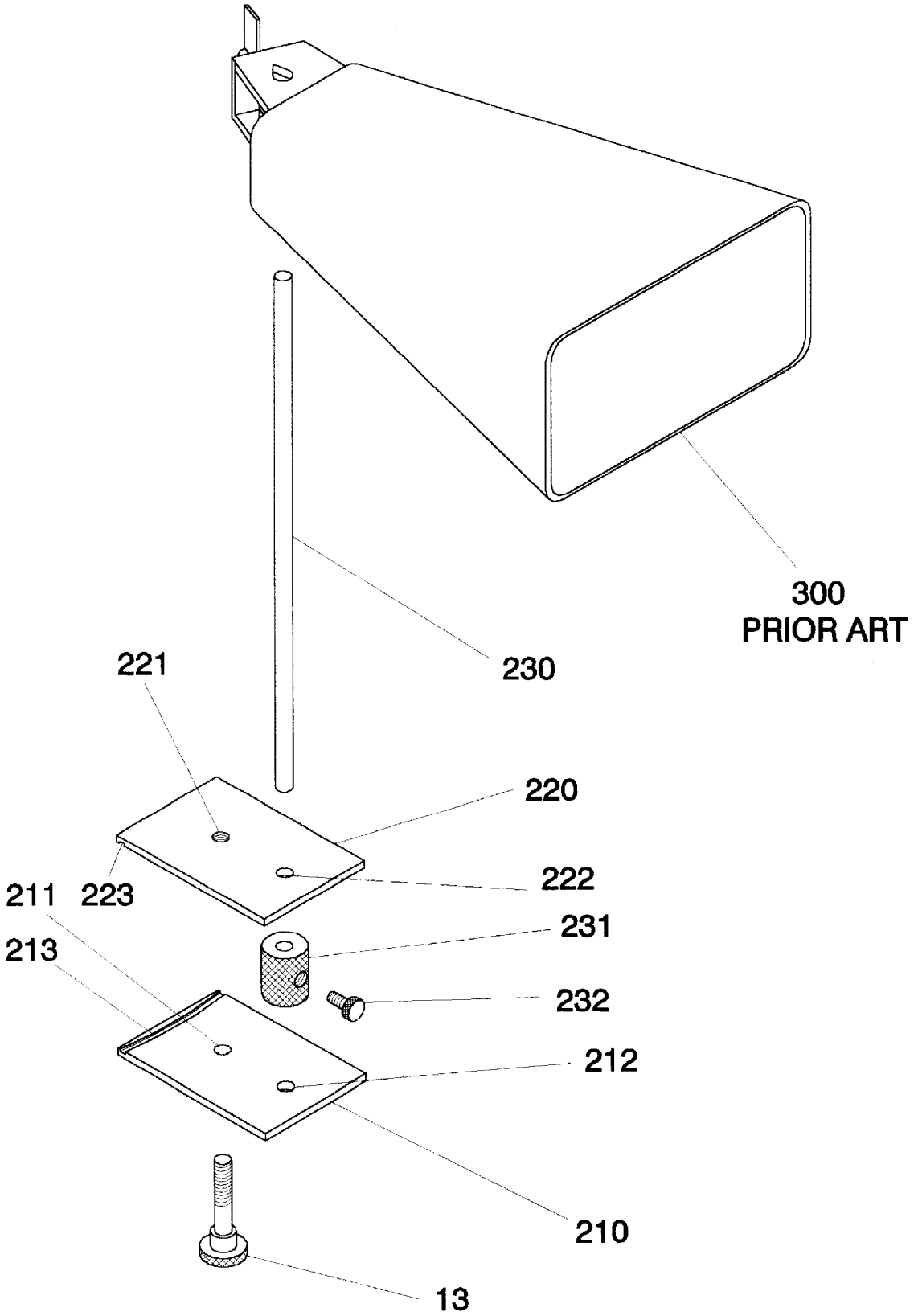
FIG. 7 is an exploded view of the alternate embodiment of the present invention.
Figure 8:
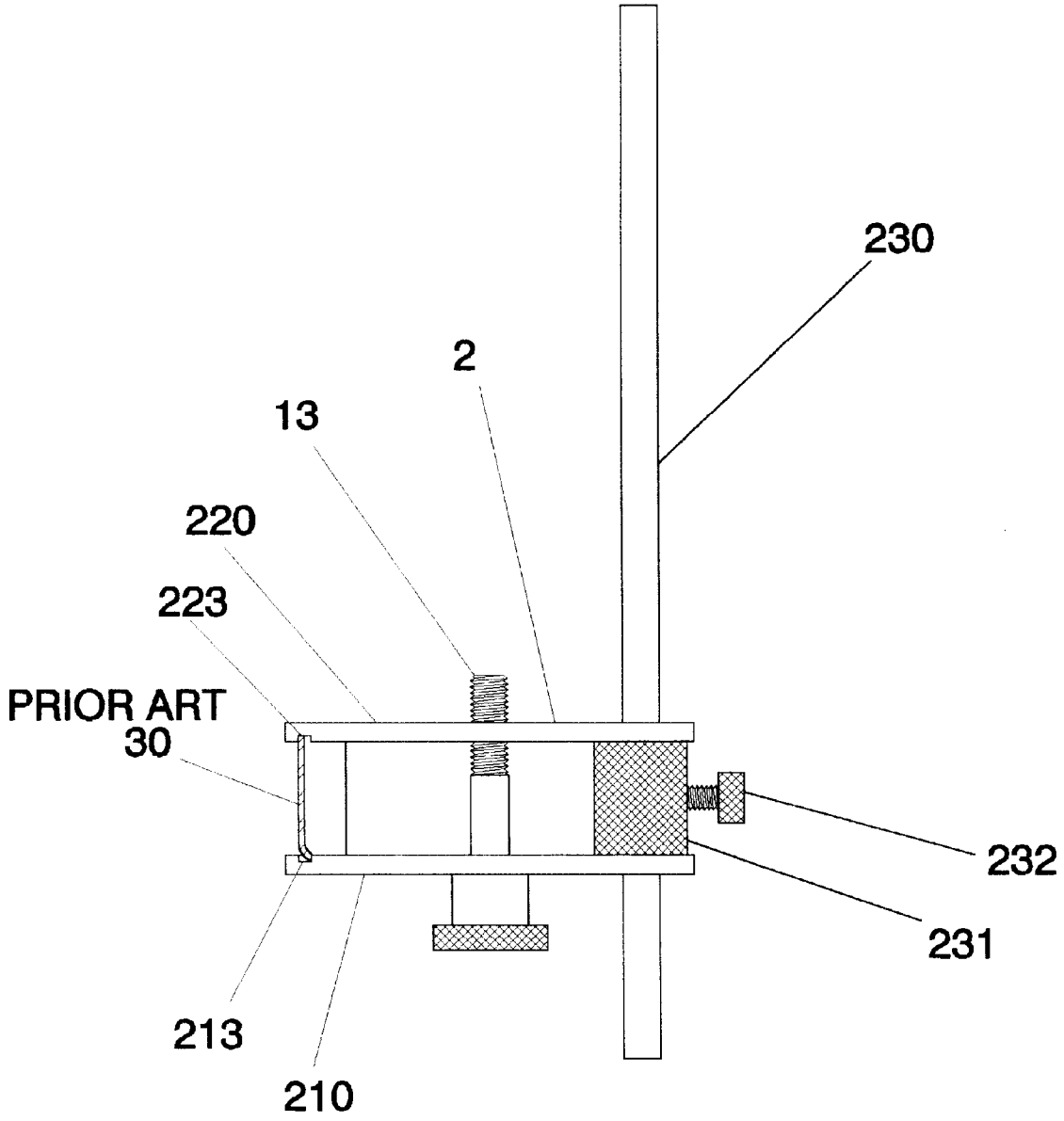
FIG. 8 is a side view of the alternate embodiment of the present invention.

FIGS. 6, 7, and 8 show an alternate embodiment of the present invention, an accessory bracket assembly 2 such as would be used for mounting a prior art accessory 300 to the prior art drum head rim 30 of the prior art drum 31.

The accessory bracket assembly 2 comprises an upper accessory plate 220, a lower accessory plate 210, a support 230, a positioning cylinder 231, a lock screw 232, and the center fastener 13.

The upper accessory plate 220 includes a fastener threaded clearance 221, an upper plate support clearance 222, and an upper accessory plate locating slot 223.

The lower accessory plate 210 includes a fastener clearance 211, a lower plate support clearance 212, and a lower accessory plate locating slot 213.

The positioning cylinder 231 includes a lock screw threaded aperture 233.

Both of the slots 223 and 233 are suitable for clamping on to the drum head rim 230.

As shown in FIGS. 6, 7, and 8, the plates 210 and 220 clamp on the drum rim 30 held together, against both the drum rim 30 and the positioning cylinder 231 by the center fastener 13. The positioning cylinder 231 serves a fulcrum for the plates 210 and 220 when the center fastener 13 is clamping the plates 210 and 220 against both the drum rim 30 and the positioning cylinder 231. The support 230 is inserted through the positioning cylinder 231. The support 230 is held in position within the positioning cylinder 231 by the lock screw 231. This arrangement permits a height adjustment for whatever type of prior art accessory 300 the support 230 is supporting. In FIGS. 6 and 7, the support 230 is indicated as a shaft to which a commercially available cowbell is indicated as the prior art accessory 300, said cowbell typically attachable to the support 230. However, as obvious to anyone skilled in the art, the support 230 could as well include a hook at the top permitting the hanging of a different type of bell in a different manner, or a musical triangle, or other such item as is deemed of musical value by a musician.

The preferred materials of the fasteners and nuts are metal, such as brass or steel.

The support 230 would typically be of metal.

Although the description above contains many specificities, these should not be construed as limiting the scope of the invention but as merely providing illustrations of some of the presently preferred embodiments of this invention. For example, a wooden block and a bell are used as examples of musical accessories that a musician might desire to mount on a drum head. As obvious to anyone skilled in the art, there are other types of items a musician might deem as emitting a musical sound, such as a metal triangle, a metal ring, or whatever. Thus the scope of the invention should be determined by the appended claims and their legal equivalents, rather than by the examples given.

We claim:

1. A device that attaches to a rim of a drum for the purpose of supporting an accessory comprising:

a) a lower plate with a slot, b) an upper plate with a slot, c) a fulcrum between said lower plate with a slot and said upper plate with a slot, d) a fastener for securing the plates as clamps around the rim of the drum, e) a spring that is located between the plates and exerts a force against each of the plates, f) at least one tension adjusting thumbscrew, g) at least one pivot shoulder bolt with a dimple which receives said tension adjusting thumbscrew, said pivot shoulder bolt threaded into the upper plate, h) at least one location adjustment insert with clearances which permit said location adjustment insert to swivel, i) at least one stud, j) a block mount nut with internal threads for each stud, and k) a height adjustment nut with each stud, said height adjustment nut serving as a means of adjusting the height of an the accessory.

2. A device for supporting an accessory from a rim of a drum comprising:

a) an upper plate with a slot suitable for clamping onto the rim of the drum, b) a lower plate with a slot suitable for clamping onto the rim of the drum, c) a positioning cylinder, d) a lock screw, e) a fastener, and f) a support wherein the fastener holds the plates clamped on the rim with the support inserted through the plates and the positioning cylinder contained between the plates, with the lock screw holding the support in position, said positioning cylinder serving as a fulcrum for the above said plates.

3. A device for mounting a musical accessory to a drum head rim which is a bracket assembly comprising:

a) an upper plate with a slot, b) a lover plate with a slot, c) a spring which is between and exerting force against said plates, d) a fulcrum, e) a fastener for clamping the above plates to said drum head rim and also to the fulcrum, and f) a means of supporting said accessory, wherein the means of supporting said musical accessory by the bracket assembly is a post secured within the bracket assembly by a positioning cylinder with a lock screw, said positioning cylinder contained within said plates.

4. The device of claim 3 wherein there is an adjustment for height of the accessory with respect to the bracket assembly, said adjustment comprising a support contained within a cylinder with a lock screw, said cylinder contained between the upper plate and the lover plate.

5. The device of claim 3 wherein wherein there is an adjustment for the height of the accessory with respect to the bracket assembly, said adjustment comprising a retaining and height adjustment nut on a mount stud, said retaining and height adjustment nut on the mount stud supporting the accessory so that, by adjusting the nut on said stud, the accessory height is adjusted.

* * * * *